US008657013B2

(12) United States Patent
Kotrla et al.

(10) Patent No.: US 8,657,013 B2
(45) Date of Patent: Feb. 25, 2014

(54) RISER SYSTEM

(75) Inventors: John E. Kotrla, Katy, TX (US); Stephen J. Walker, Houston, TX (US); William F. Puccio, Katy, TX (US)

(73) Assignee: Cameron International Corporation, Houston, TX (US)

( * ) Notice: Subject to any disclaimer, the term of this patent is extended or adjusted under 35 U.S.C. 154(b) by 146 days.

(21) Appl. No.: 13/213,184

(22) Filed: Aug. 19, 2011

(65) Prior Publication Data

US 2013/0043036 A1 Feb. 21, 2013

(51) Int. Cl.
*E21B 17/01* (2006.01)

(52) U.S. Cl.
USPC ..... 166/367; 166/345; 166/352; 138/177; 405/224.2

(58) Field of Classification Search
USPC ..... 166/345, 344, 351, 352, 367, 378–380; 138/177; 405/169, 170, 224.2, 224.4
See application file for complete search history.

(56) References Cited

U.S. PATENT DOCUMENTS

| | | | | | |
|---|---|---|---|---|---|
| 3,252,192 | A | * | 5/1966 | Smith | 269/117 |
| 3,501,173 | A | * | 3/1970 | Linder et al. | 285/114 |
| 4,078,605 | A | * | 3/1978 | Jones | 166/359 |
| 4,188,156 | A | | 2/1980 | Fisher et al. | |
| 4,363,567 | A | * | 12/1982 | Van der Graaf | 405/224.2 |
| 4,403,658 | A | | 9/1983 | Watkins | |
| 4,470,621 | A | * | 9/1984 | Irvine | 285/114 |
| 4,470,722 | A | * | 9/1984 | Gregory | 405/224.2 |
| 4,635,970 | A | * | 1/1987 | Haines | 285/114 |
| 4,646,840 | A | | 3/1987 | Bartholomew et al. | |
| 5,161,828 | A | * | 11/1992 | Hynes et al. | 285/2 |
| 5,377,763 | A | * | 1/1995 | Pearce et al. | 166/367 |
| 5,390,966 | A | * | 2/1995 | Cox et al. | 285/124.2 |
| 5,439,323 | A | * | 8/1995 | Nance | 405/195.1 |
| 5,580,102 | A | * | 12/1996 | Stultz | 285/61 |
| 5,657,823 | A | * | 8/1997 | Kogure et al. | 166/340 |
| 5,660,233 | A | * | 8/1997 | Sparks | 166/367 |
| 5,775,845 | A | * | 7/1998 | Wybro | 405/195.1 |
| 6,102,673 | A | * | 8/2000 | Mott et al. | 417/392 |
| 6,230,824 | B1 | * | 5/2001 | Peterman et al. | 175/214 |
| 6,325,159 | B1 | * | 12/2001 | Peterman et al. | 175/7 |
| 6,367,554 | B1 | | 4/2002 | Theiss | |
| 6,415,867 | B1 | * | 7/2002 | Deul et al. | 166/367 |
| 6,419,277 | B1 | * | 7/2002 | Reynolds | 285/123.1 |
| 6,561,714 | B1 | * | 5/2003 | Williams et al. | 403/2 |
| 6,615,922 | B2 | * | 9/2003 | Deul et al. | 166/367 |
| 6,623,044 | B1 | * | 9/2003 | Guesnon et al. | 285/124.1 |
| 7,210,531 | B2 | * | 5/2007 | van Belkom | 166/367 |
| 7,329,070 | B1 | | 2/2008 | Trent et al. | |
| 7,568,861 | B2 | * | 8/2009 | Godoy et al. | 405/211 |

(Continued)

FOREIGN PATENT DOCUMENTS

WO 2010097528 A1 9/2010

OTHER PUBLICATIONS

PCT International Search Report and Written Opinion for PCT/US2012/050771, dated Mar. 5, 2013.

*Primary Examiner* — Matthew Buck
(74) *Attorney, Agent, or Firm* — Chamberlain Hrdlicka

(57) ABSTRACT

A riser system for coupling a surface platform to a wellhead. The riser system includes a main tube, flanges and one or more tie rods. The main tube forms an annulus for fluid flow between the wellhead and the platform. A flange extends radially from each end of the main tube. The tie rods are coupled to and extend between the flanges.

17 Claims, 4 Drawing Sheets

(56) References Cited

U.S. PATENT DOCUMENTS 8,037,939 B2 * 10/2011 Poirette et al. ..... 166/367
8,322,438 B2 * 12/2012 Larson et al. ..... 166/367
2009/0212092 A1 * 8/2009 Stol ..... 228/112.1
2012/0312544 A1 * 12/2012 Tavner et al. ..... 166/367

* cited by examiner

RISER SYSTEM

BACKGROUND

Drilling operations for the recovery of offshore deposits of crude oil and natural gas are taking place in deeper and deeper waters. Drilling operations in deeper waters are typically carried out from floating vessels rather than from stationary platforms resting on the ocean floor and commonly used in shallow water. According to conventional procedures, a drilling vessel is dynamically stationed, or moored, above a well site on the ocean floor. After a wellhead has been established, a blowout preventer (BOP) stack is mounted on the wellhead to control the pressure at the surface.

Subsea well boreholes are typically drilled with multiple sections having decreasing diameters as the wellbore extends deeper into the earth. Each borehole is cased with a casing string that extends into the borehole from a wellhead and is cemented within the borehole. The drilling, casing installation, and cementing are performed through one or more risers that extend from the wellhead to the surface, such as to a floating drilling vessel.

A riser pipe extends from the floating vessel to the wellhead equipment on the ocean floor to conduct downhole operations. The riser is attached to the wellhead equipment and is supported in tension at or near the water surface. In drilling the borehole for the well, a drill string is passed from the floating vessel down through the riser and wellhead equipment and into the borehole.

The floating drilling vessel applies tension at the top of the riser to support the weight of the riser and the drilling fluid in the riser. This necessitates that the riser have sufficient strength to handle the tension thereby requiring that the thickness of the wall of the riser be increased which in turn increases the weight of the riser. The more weight that is required, the greater the tension that is required.

Drilling mud is circulated down through the drill string and returned to the vessel through the annulus formed between the riser and the drill pipe. It is necessary for the riser, extending several thousand feet, to handle the pressure of all of the drilling mud needed for drilling the borehole sections. The difference in density between the drilling mud and sea water causes the fluid column in the riser to create a large pressure differential that must be contained within the riser. The column of drilling mud can be approximately twice as heavy as sea water such that for every foot of depth, there is about one-half psi of mud gradient weight so that at a depth of 10,000 feet, there could be 5,000 psi inside the riser relative to the sea water around the riser.

The drilling fluids in the riser also form a fluid column placing a hydrostatic head on the well for well control purposes. Well control is established by maintaining the density of the drilling fluid, and thus the hydrostatic pressure exerted on the subsurface formations, at a level that is sufficient to prevent the production fluids under pressure in the formation from overcoming the hydrostatic head. If the hydrostatic head on the well is insufficient, the pressurized gas and other formation fluids may exceed the hydrostatic head leading to a blowout.

On the other hand, if the hydrostatic head is too great, the hydrostatic head may force drilling fluids into the formation causing the loss of drilling fluids into the formation or a reduction or loss in production. If too much drilling fluid is lost into the formation and the level of drilling fluid drops in the riser, the hydrostatic head can decrease below the pressure of the formation and cause a blowout. Furthermore, the hydrostatic head may increase to an amount so as to fracture the formation resulting in increased lost circulation.

According to conventional practice, various auxiliary fluid lines may be coupled to the exterior of the riser tube. Exemplary auxiliary fluid lines include choke, kill, booster, glycol, and hydraulic fluid lines. Choke and kill lines typically extend from the drilling vessel to the wellhead to provide fluid communication for well control and circulation. The choke line is in fluid communication with the borehole at the wellhead and bypasses the riser to vent gases or other formation fluids directly to the surface. A surface-mounted choke valve is connected to the terminal end of the choke conduit line. The downhole back pressure can be maintained substantially in equilibrium with the hydrostatic pressure of the column of drilling fluid in the riser annulus by adjusting the discharge rate through the choke valve.

The kill line is primarily used to control the density of the drilling mud. One method of controlling the density of the drilling mud is by the injection of relatively lighter drilling fluid through the kill line into the bottom of the riser to decrease the density of the drilling mud in the riser. On the other hand, if it is desired to increase mud density, a heavier drilling mud is injected through the kill line.

The booster line allows additional mud to be pumped to a desired location so as to increase fluid velocity above that point and thereby improve the conveyance of drill cuttings to the surface. The booster line can also be used to modify the density of the mud in the annulus. By pumping lighter or heavier mud through the booster line, the average mud density above the booster connection point can be varied. While the auxiliary lines provide pressure control means to supplement the hydrostatic control resulting from the fluid column in the riser, the riser tube itself provides the primary fluid conduit to the surface.

In some riser systems the auxiliary fluid lines cooperate with the riser main tube to share the tensile forces applied to support the riser.

SUMMARY

A riser system for coupling a surface platform to a wellhead is disclosed herein. In one embodiment, a riser section includes a main tube, flanges and one or more tie rods. The main tube forms an annulus for fluid flow between the wellhead and the platform. A flange extends radially from each end of the main tube. The tie rods are coupled to and extend between the flanges.

In another embodiment, a drilling system for boring earthen formations includes a drilling platform, a subsea wellhead, and a riser string disposed between the drilling platform and the subsea wellhead. The riser string includes a plurality of riser sections. At least one of the riser sections includes one or more ties rods coupled to and extending between flanges radiating from each end of the riser section. The tie rods are configured to share a tensile load applied to the riser section.

BRIEF DESCRIPTION OF THE DRAWINGS

For a detailed description of exemplary embodiments of the invention, reference will now be made to the accompanying drawings, which are not necessarily drawn to scale, in which.

NOTATION AND NOMENCLATURE

Figure 1:
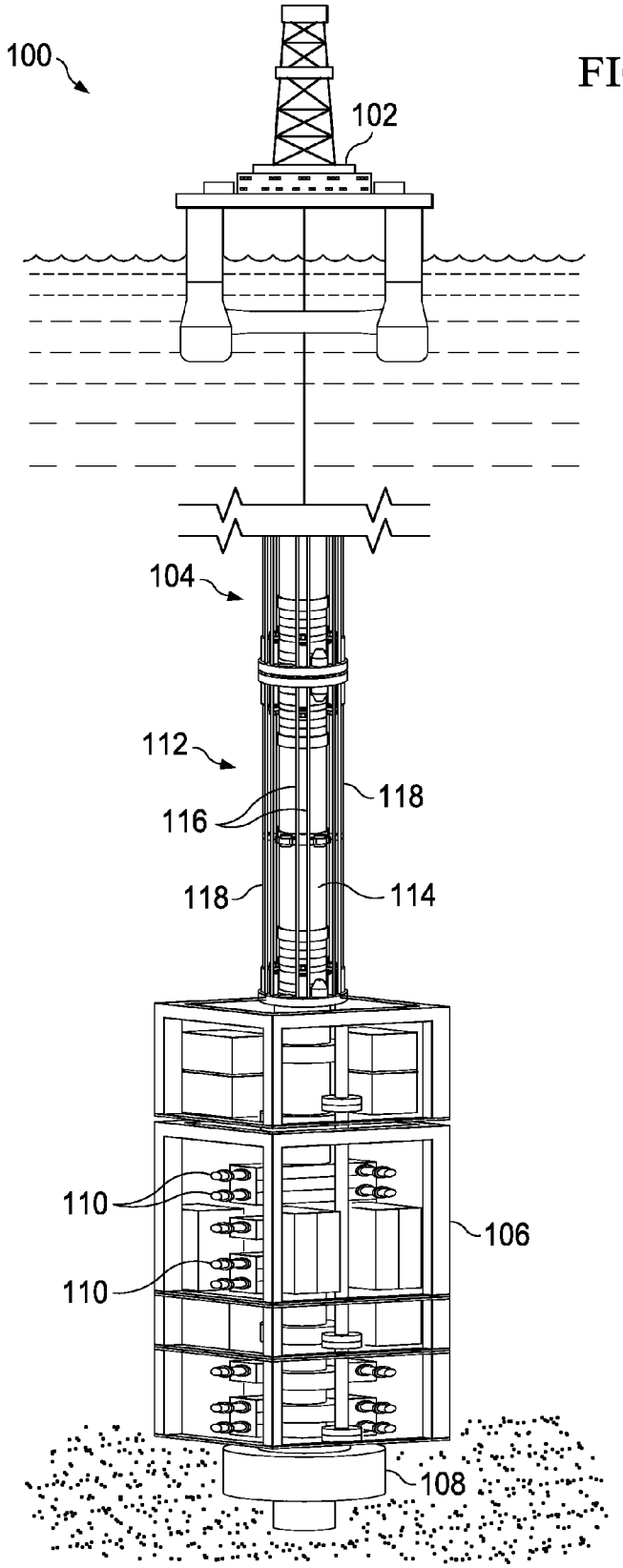
FIG. 1 shows a drilling system including a tie rod enhanced riser system in accordance with various embodiments.

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

The riser string extends from the blowout preventer (BOP) at the sea floor to the drilling rig at the surface. The riser serves a number of important functions. For example, the riser string provides: an annulus for flow of spent drilling fluid, a structure to support auxiliary fluid lines, a guide to the well bore for the drill bit and other tools, and a means to operate the BOP. The riser string is supported by tension lines at the surface. The auxiliary fluid lines run along the riser string between the surface and the blowout preventer. The auxiliary fluid lines may bear at least a portion of the load to which the riser string is subject when deployed in the subsea environment. For example, the auxiliary fluid lines may bear a portion of the tensile load applied from the surface to support the riser string. This arrangement advantageously distributes the riser load bearing capacity across multiple structural elements of a riser joint. However, since the auxiliary fluids lines differ in size and are not equally spaced about the main tube, the load sharing riser string is weaker in the direction of omitted and/or smaller auxiliary fluid lines. As with any columnar loaded member, the overall strength of the riser is determined by the strength of the riser in its weakest direction.

Embodiments of the riser string disclosed herein include a riser joint having tie rods extending lengthwise along the riser joint. Tie rods are structural support members extending between elements of an apparatus. In embodiments of the riser joint disclosed herein, the tie rods may be applied to strengthen the riser joint in its weakest direction, making the polar moment of inertia of the riser joint more uniform. Thereby making the entire riser string capable of sustaining greater loads.

FIG. 1 shows a drilling system 100 in accordance with various embodiments. The drilling system 100 includes a drilling rig 102, a riser string 104, and a blowout preventer stack 106. The blowout preventer 106 is connected to a wellhead housing 108 disposed on the ocean floor. The blowout preventer stack 106 includes multiple blowout preventers 110 in a vertical arrangement to control well bore pressure. The riser string 104 is coupled to the upper end of blowout preventer stack 106. The riser string 104 includes multiple riser sections or riser joints 112 connected end to end and extending upward to the drilling rig 102.

Each riser joint 112 includes a main tube 114 and one or more tie rods 116 disposed along the main tube 114. Embodiments may also include one or more auxiliary fluid lines 118. The tie rods 116 share the loads applied to the riser joint 112 with the main tube 114 and, in some embodiments, with the auxiliary fluid lines 118.

Figure 2A:
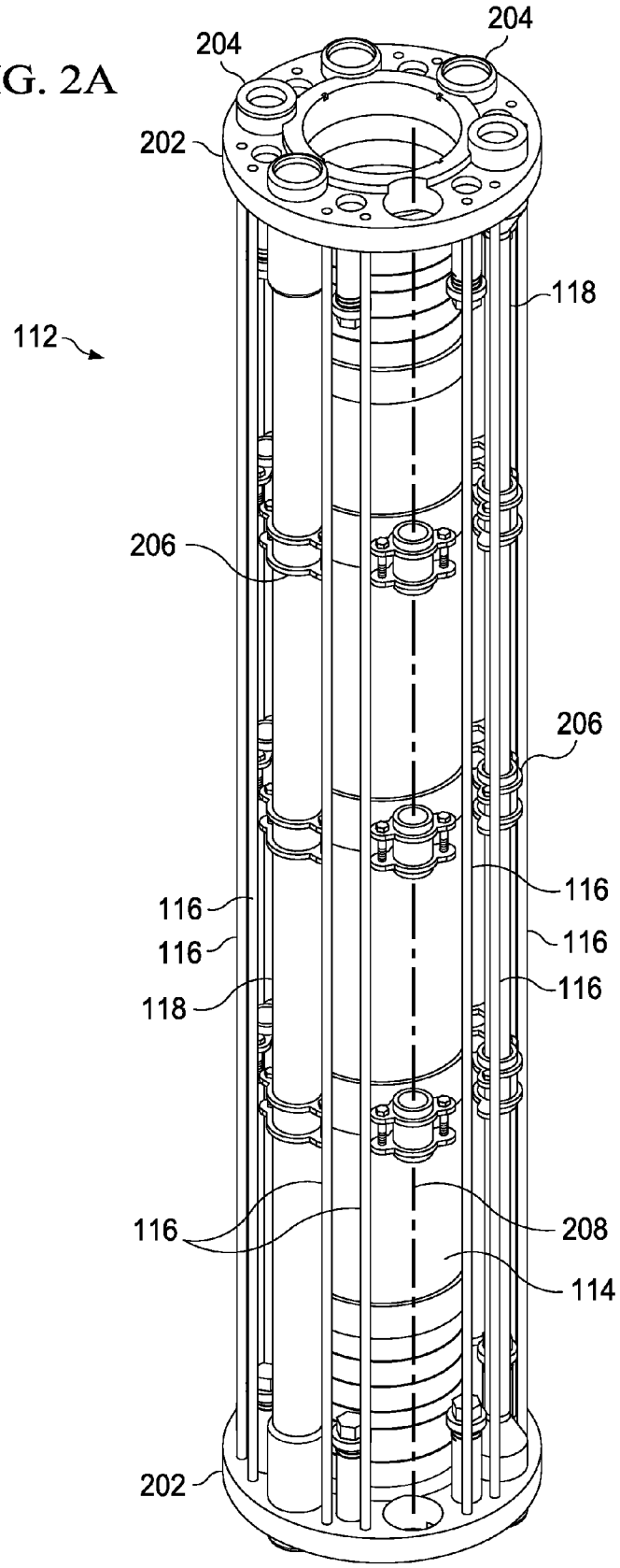
FIG. 2A shows a riser section including tie rods in accordance with various embodiments.

FIG. 2A shows the riser section 112 including tie rods 116 in accordance with various embodiments. The riser section 112 includes flanges 202 disposed at each end, with the main tube 114, auxiliary fluid lines 118, and tie rods 116 extending between the flanges 202. Instances of the riser section 112 are connected end-to-end at the flanges by bolts, dogs, or other suitable fasteners. Each end of the main tube 114 and the auxiliary fluid lines 118 sealingly mates with a corresponding end of a different instance of the riser section 112 to form continuous fluid channels between the rig 102 and the blowout preventer 106.

Embodiments of the riser section 112 include various numbers of auxiliary fluid lines 118 and/or tie rods 116. The embodiment of FIG. 6 includes five auxiliary fluid lines 118. Other embodiments may include fewer or more auxiliary fluid lines 118. In some embodiments of the riser section 112, the auxiliary fluid lines 118 are secured to the flanges 202 and/or secured to the main tube 114. Nuts 204 may be coupled to a threaded end of the auxiliary fluid line 118 to secure the auxiliary fluid line 118 to the flange 202, and clamps 206 may secure the auxiliary fluid line 118 to the main tube 114. Some embodiments of the riser section 112 employ other and/or different fastening mechanisms to secure the auxiliary fluid lines 118 to the flange 202 and/or the main tube 114.

The auxiliary fluid lines 118 may share, with the main tube 114, tensile and other forces applied to the riser section 112. However, the load bearing capacity of the auxiliary fluid lines 118 of the riser section 112 may be asymmetrical. For example, the riser section 112 includes five auxiliary fluid lines that are unevenly spaced about the main tube 114. I.e., no auxiliary fluid line is provided at position 208 of the riser section 112 for load sharing, causing asymmetry in load sharing by the auxiliary fluid lines 118. Additionally, the auxiliary fluid lines 118 may be of different sizes and/or have different load bearing capacities. For example, choke or kill lines may employ larger and/or heaver tubing than other fluid lines, causing asymmetry in load sharing by the auxiliary fluid lines 118.

The tie rods 116 are coupled to the flanges 202, and carry at least a portion of the load applied to the rise section 112. The tie rods 116 may be threaded to the flanges or secured thereto by other suitable attachment device or technique. Various embodiments of the tie rods 116 may have square, circular, or other suitable cross section. The riser section 112 includes 12 tie rods 116 evenly spaced about the main tube 112. Other riser section embodiments may include a different number of tie rods 116 with even or uneven spacing.

In some embodiments of the riser section 112, the tie rods 116 may sustain all or most of the tensile load applied to the riser section 112. Because the tie rods 116 carry a portion of the tensile load applied to the riser section 112, the strength of the main tube 114 and/or the strength of the auxiliary tubes 118 may be reduced. For example, the wall thickness of the main tube 114 and/or the auxiliary fluid lines 118 may be reduced, potentially reducing the weight of the riser section 112. Thus, embodiments of the riser section 112 may, without loss of tensile strength, employ lighter and/or thinner tubes 114, 118 than conventional riser sections of equivalent strength that employ the same tubing material as the riser section 112 but lack tie rods 116.

The materials flowing in the annulus formed by the main tube 114 may dictate the materials from which the main tube 114 is formed. For example, to accommodate hydrogen sulfide in the fluid flowing through the main tube 114, National Association of Corrosion Engineers standards may limit the main tube 114 to an 80K material, which also limits the tensile strength of the tube 114. Because the tie rods 116 are not exposed to the drilling fluid within the annulus, the tie rods are not subject to the material restrictions of the main tube 114, and may be formed of a higher tensile strength material than the main tube 114.

In some embodiments of the riser section 112, the tie rods 116 compensate for asymmetrical load sharing among the auxiliary fluid lines 118, producing in the riser section 112 having an omni-directional load bearing profile. Asymmetrical load sharing among the auxiliary fluid lines 118 may result, for example, from lack of an auxiliary fluid line 118 or from differing strength of included auxiliary fluid lines 118. Embodiments of the riser section 112 compensating for lack of an auxiliary fluid line 118 may include a tie rod 116 only in circumferential areas of the riser section 112 where no load-sharing auxiliary fluid line 118 is disposed. Embodiments of the riser section 112 compensating for differing strength among auxiliary fluid lines 118 include stronger tie rods 116 positioned in association with lower strength auxiliary fluid lines 118 and/or lower strength tie rods positioned in association with higher strength auxiliary fluid lines 118. Tie rod strength may be based on rod material, rod thickness, etc. Some embodiments of the riser section 112 may include tie rods 116 compensating for both missing auxiliary fluid lines 118 and strength difference among auxiliary fluid lines 118.

Figure 2B:
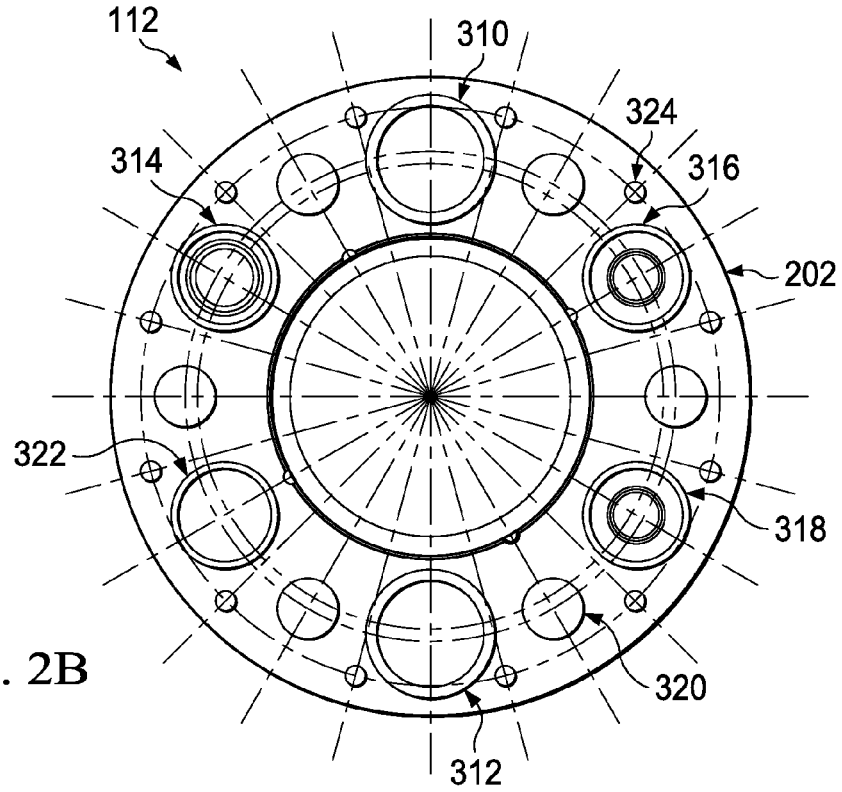
FIG. 2B shows an end view of the riser section including tie rods in accordance with various embodiments.

FIG. 2B shows an end view of the riser section 112 including tie rods 116 in accordance with various embodiments. The various auxiliary lines disposed about the main tube 114 include a choke line 310, a kill line 312, a mud boost line 314, and hydraulic fluid lines 316, 318. The choke line 310 and the kill line 312 may be 6.25" (OD)×4.25" (ID) pipes, the hydraulic fluid lines 316, 318 may be 3.63"×3" pipes, and the mud boost line 314 may be a 5"×4" pipe. Other pipe diameters may also be used. Bolt holes 320 are arranged about the flange 202 for connecting the riser section 112 to a different riser section or structure by bolts or other connecting device. Some embodiments of the flange 202 include lift lug hole 322 that can be used by lifting equipment to handle the riser section 112.

Tie rod holes 324 are distributed about the flange 202 for attaching tie rods 116 to the riser section 112. In some embodiments of the riser section 112, a tie rod 116 is connected to the flange 202 at each hole 324. In other embodiments of the riser section 112, tie rods 116 are connected to the flange 202 at some of the holes 324, while other of the holes 324 are empty. The determination of whether to connect a tie rod 116 at a hole 324 may be based, for example, on the load bearing capacity of the auxiliary lines near the tie rod hole 324.

Figure 3A:
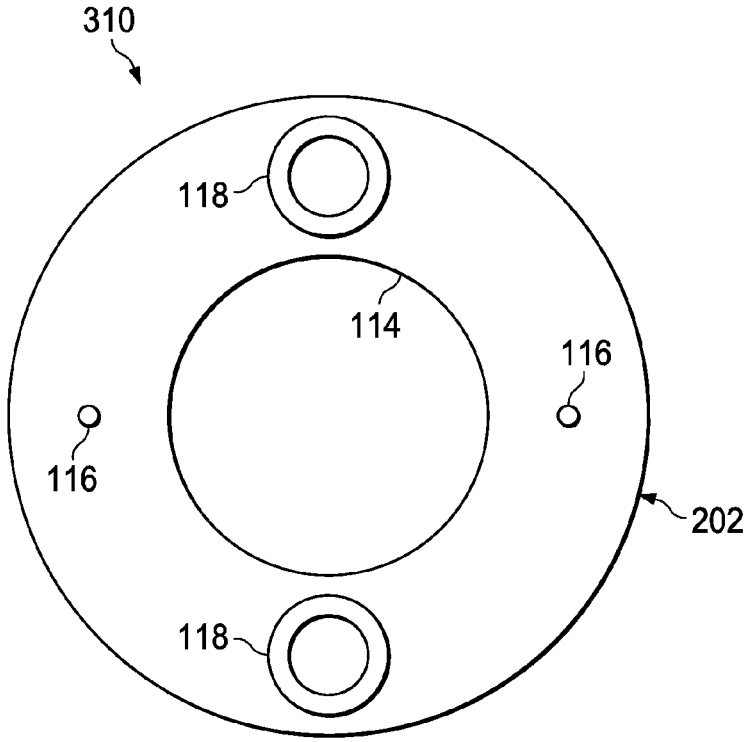
FIGS. 3A-3C show flange views of various exemplary tie rod arrangements employed to enhance riser joint strength.
Figure 3B:
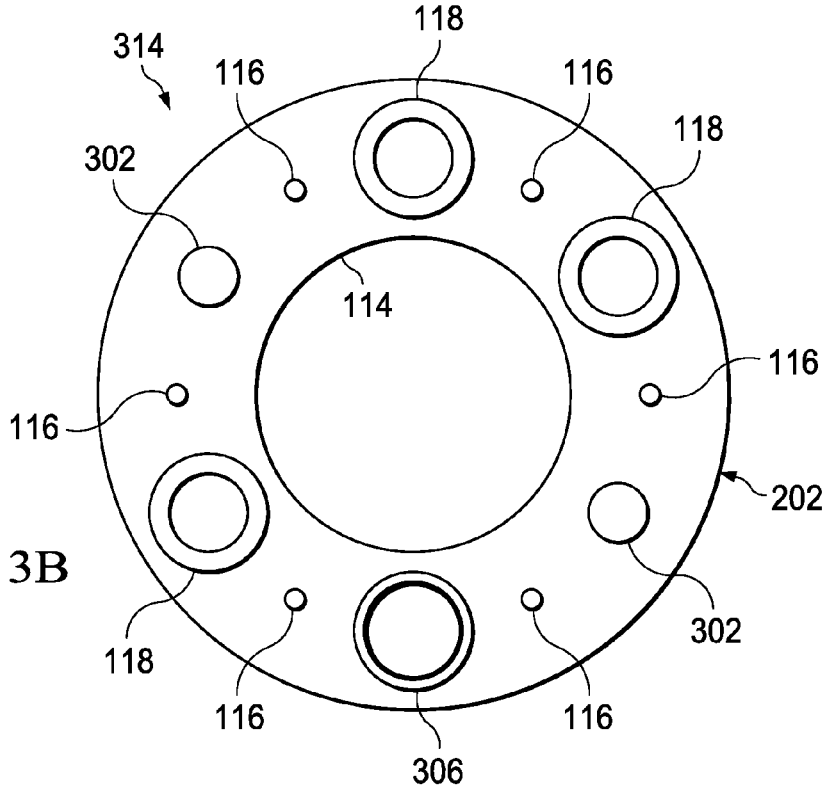
Figure 3C:
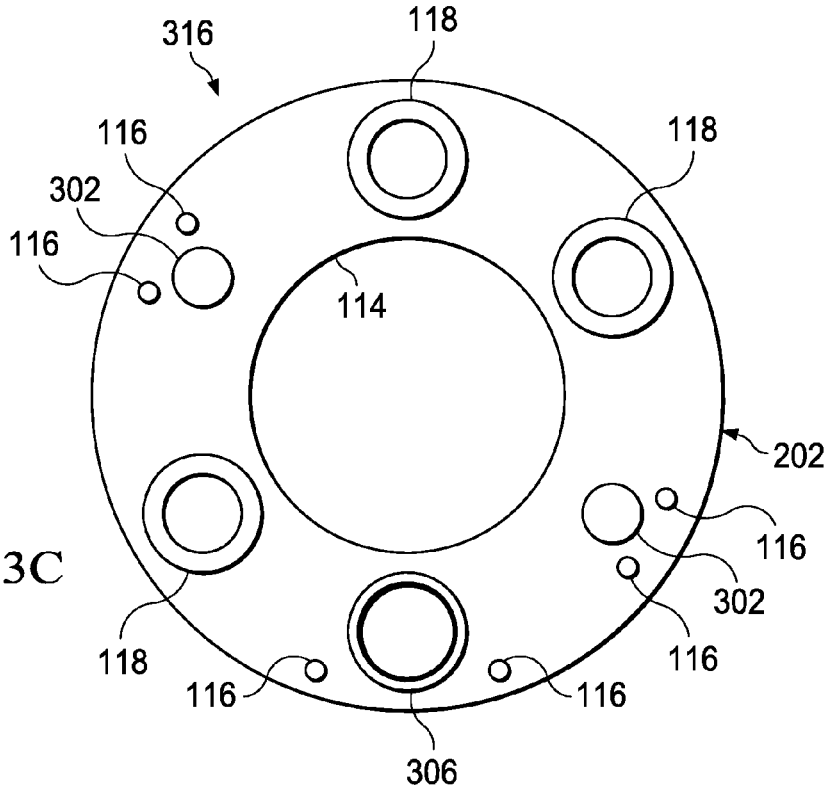

FIGS. 3A-3C show flange views of various exemplary tie rod arrangements employed to enhance riser joint strength, and are intended to illustrate configurations where tie rods are applied to advantage rather than to illustrate all features of the flange end of a riser joint. FIG. 3A shows a riser joint 310 including a plurality of auxiliary fluid lines 118 that load share with the main tube 114. In FIG. 3A, the auxiliary fluid lines 118 are disposed on opposite sides of the main tube 114. Tie rods 116 are disposed in circumferential areas of the riser joint 310 that lack load sharing auxiliary fluid lines. The tie rods 116 load share with the main tube 114, and compensate for the lack of load sharing auxiliary fluid lines in the areas where the tie rods 116 are positioned. Other embodiments of riser joint may include a different number and/or arrangement of auxiliary fluid lines 118 and tie rods 116 providing a symmetrical load profile.

FIG. 3B shows a riser joint 312 including larger auxiliary fluid lines 118 and smaller auxiliary fluid lines 302. Each of the larger auxiliary fluid lines 118 can bear a greater load than one of the smaller auxiliary fluid lines 302. Tie rods 116 are interspersed between the auxiliary fluid lines 118, 302. In some embodiments of the riser joint 312, the tie rods 116 bear most or substantially all of the tensile load applied to the riser joint. In some embodiments, the tie rods 116 may be pre-loaded, and/or the auxiliary fluid lines 118, 302 may be configured for non-load sharing (e.g., not rigidly coupled to the flange 202).

FIG. 3C shows a riser joint 316 including larger auxiliary fluid lines 118 and smaller auxiliary fluid lines 302. Each of the larger auxiliary fluid lines 118 can bear a greater load than one of the smaller auxiliary fluid lines 302. Tie rods 116 are associated with each of the smaller auxiliary fluid lines 302, and with circumferential areas of the riser joint 316 lacking load sharing auxiliary fluid lines (e.g., the opening 306). The tie rods 116 are arranged to provide symmetrical load sharing about the circumference of the riser joint 316. Accordingly, embodiments of the tie rods 116 may be configured to bear a greater or lesser load at different positions about the riser joint 316. For example, because the area about the opening 306 lacks a load sharing auxiliary fluid line, the tie rods 116 about the opening 306 may be configured to bear a greater load than the tie rods 116 about the auxiliary fluid lines 302. The combination of tie rods 116 and/or tie rods 116 and auxiliary fluid lines 302 may be configured to approximate the load bearing capacity of the larger auxiliary fluid line 118. The load bearing capacity of each tie rod 116 may be determined by the material, diameter, and/or manufacturing process associated with the tie rod 116.

The above discussion is meant to be illustrative of the principles and various embodiments of the present invention. Numerous variations and modifications will become apparent to those skilled in the art once the above disclosure is fully appreciated. For example, the various features illustrated and/or discussed with regard to riser sections 112, 310, 314, and 316 may be combined and applied to a riser section embodiment and used with the drilling system 100. It is intended that the following claims be interpreted to embrace all such variations and modifications.

What is claimed is:

1. A riser section for coupling a surface platform to a wellhead, the riser section comprising:

a main tube for fluid flow between the wellhead and the platform;

a flange extending radially from each end of the main tube;

tie rods coupled to and extending between the flanges to share a tensile load applied to the riser section and transferred through the flanges;

an auxiliary fluid line extending between the flanges to share the tensile load applied to the riser section; and wherein the tie rods are disposed to counter an imbalance in tensile strength of the riser section caused by at least one of size and arrangement of the auxiliary fluid line.

2. The riser section of claim 1, further comprising multiple auxiliary fluid lines extending between the flanges, the auxiliary fluid lines configured to share the tensile load applied to the riser section.

3. The riser section of claim 2, wherein the tie rods are disposed to counter an imbalance in tensile strength of the riser section caused by at least one of size and arrangement of the auxiliary fluid lines.

4. The riser section of claim 1, wherein the tie rods are threadingly coupled to the flanges.

5. The riser section of claim 1, wherein the tie rods are unevenly spaced about the circumference of the main tube.

6. The riser section of claim 2, wherein the positions of the tie rods are based, at least in part, on the positions of the auxiliary fluid lines.

7. The riser section of claim 1, wherein a circumferential wall of the main tube is thinner than would be necessary to withstand a given load than without the tie rods.

8. The riser section of claim 1, wherein the tie rods are disposed to provide the riser section with an omni-directional load bearing profile.

9. The riser section of claim 1, wherein the tie rods comprise material of higher tensile strength than a material of the main tube.

10. The riser section of claim 2, wherein the tie rods differ in tensile strength, and tie rods of higher tensile strength are disposed in areas of lower auxiliary fluid line tensile load sharing, and tie rods of lower tensile strength are disposed in areas of higher auxiliary fluid line tensile load sharing.

11. The riser section of claim 2, wherein tensile strength of the tie rods disposed in a circumferential area around the main tube inversely corresponds to tensile load sharing capability of the auxiliary fluid lines disposed in the circumferential area.

12. A drilling system for boring earthen formations using a drilling platform, the drilling system comprising:

a subsea wellhead; and a riser string disposed between the drilling platform and the subsea wellhead, the riser string comprising a plurality of riser sections, at least one of the riser sections comprising:

a main tube for fluid flow between the subsea wellhead and the drilling platform;

a flange extending radially from each end of the main tube;

tie rods coupled to and extending between the flanges to share a tensile load applied to the riser section and transferred through the flanges;

an auxiliary fluid line extending between the flanges to share the tensile load applied to the riser section; and wherein the tie rods are disposed to counter an imbalance in tensile strength of the riser section caused by at least one of size and arrangement of the auxiliary fluid line.

13. The drilling system of claim 12, further comprising a blowout preventer coupled to the riser and to the wellhead.

14. The drilling system of claim 12, wherein the riser section comprises multiple auxiliary fluid lines extending between the flanges, the auxiliary fluid lines configured to share the tensile load applied to support the riser string, and wherein the tie rods are disposed to counter an asymmetry in tensile strength of the riser section caused by the auxiliary fluid lines.

15. The drilling system of claim 14, wherein the positions of the tie rods are based, at least in part, on the positions of the auxiliary fluid lines.

16. The drilling system of claim 14, wherein the tie rods differ from one another in tensile strength, and tie rods of higher tensile strength are disposed in areas of lower auxiliary fluid line tensile load sharing, and tie rods of lower tensile strength are disposed in areas of higher auxiliary fluid line tensile load sharing.

17. The drilling system of claim 14, wherein tensile strength of the tie rods disposed in a circumferential area of the riser section inversely corresponds to the tensile load sharing capability of the auxiliary fluid lines disposed in the circumferential area.

* * * * *